US006719645B2

(12) United States Patent
Kouno

(10) Patent No.: US 6,719,645 B2
(45) Date of Patent: Apr. 13, 2004

(54) GOLF CLUB HEAD

(75) Inventor: Masaru Kouno, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/172,991

(22) Filed: Jun. 18, 2002

(65) Prior Publication Data

US 2003/0013548 A1 Jan. 16, 2003

(30) Foreign Application Priority Data

Jun. 19, 2001 (JP) ..... 2001-185347

(51) Int. Cl.[7] ..... A63B 53/04
(52) U.S. Cl. ..... 473/345; 473/349
(58) Field of Search ..... 473/324, 345, 473/346, 329, 349, 350, 290, 291, 292, 342

(56) References Cited

U.S. PATENT DOCUMENTS 4,432,549 A * 2/1984 Zebelean ..... 473/346
5,028,049 A * 7/1991 McKeighen ..... 473/345
5,482,279 A * 1/1996 Antonious ..... 473/327
5,518,240 A * 5/1996 Igarashi ..... 473/345
5,755,627 A * 5/1998 Yamazaki et al. ..... 473/345
5,967,904 A * 10/1999 Nagai et al. ..... 473/345
6,193,614 B1 * 2/2001 Sasamoto et al. ..... 473/329
6,228,189 B1 * 5/2001 Oyama et al. ..... 148/669
6,322,459 B1 * 11/2001 Nishimura et al. ..... 473/330
6,348,013 B1 * 2/2002 Kosmatka ..... 473/329
6,354,962 B1 * 3/2002 Galloway et al. ..... 473/342
6,443,856 B1 * 9/2002 Galloway et al. ..... 473/330

FOREIGN PATENT DOCUMENTS

JP 5-015620 1/1993
JP 8-280854 10/1996
JP 3225596 8/2001

* cited by examiner

*Primary Examiner*—Sebastiano Passaniti
(74) *Attorney, Agent, or Firm*—Birch, Stewart, Kolasch & Birch, LLP

(57) ABSTRACT

A golf club head comprises a main body and a face member attached to the main body. The face member comprises a main portion forming a ball striking face and an extended part. The extended part extends 5 to 30 mm backward from at least part of the edge of the ball striking face. The thickness of the extended part is less than the thickness of the main portion.

9 Claims, 7 Drawing Sheets

GOLF CLUB HEAD

BACKGROUND OF THE INVENTION

The present invention relates to a golf club head more particularly to a structure of the front of the golf club head being capable of improving the restitution coefficient and durability.

Japanese patent No.3225596 (Publication No.JP-A-5-317466) discloses a golf club head which, as shown in FIG. 9(A), comprises a face-side member P1 and a back-side member P4. These members P1 and P4 are fixed to each other by welding. The face-side member P1 is made up of a face part P2 and a part P3 extending backward therefrom. These parts P2 and P3 are molded integral. The part P3 extending backward has, as shown in FIG. 9(B), a wedge-shaped cross section of which thickness is gradually decreased from the face side to the rear-side thereof to a value which is in a range of from 1.0 to 1.3 times the thickness of the back-side member P4. This structure is intended to avoid breakage of the junction of the face-side member P1 and back-side member P4 due to the impact at the time of ball striking.

In recent years, on the other hand, there is a great demand for golf club heads having a high restitution coefficient with respect to the stricken balls as well as durability.

SUMMARY OF THE INVENTION

It is therefore, an object of the present invention to provide a golf club head, in which the restitution coefficient is improved without sacrificing the durability.

According to the present invention, a golf club head comprises a main body and a face member attached to the main body, the face member comprising a main portion and an extended part, the main portion forming a ball striking face, wherein the extended part extending 5 to 30 mm backward from at least part of the edge of the ball striking face, and a thickness of the extended part being less than a thickness of the main portion.

DESCRIPTION OF THE PREFERRED EMBODIMENTS

Figure 1:
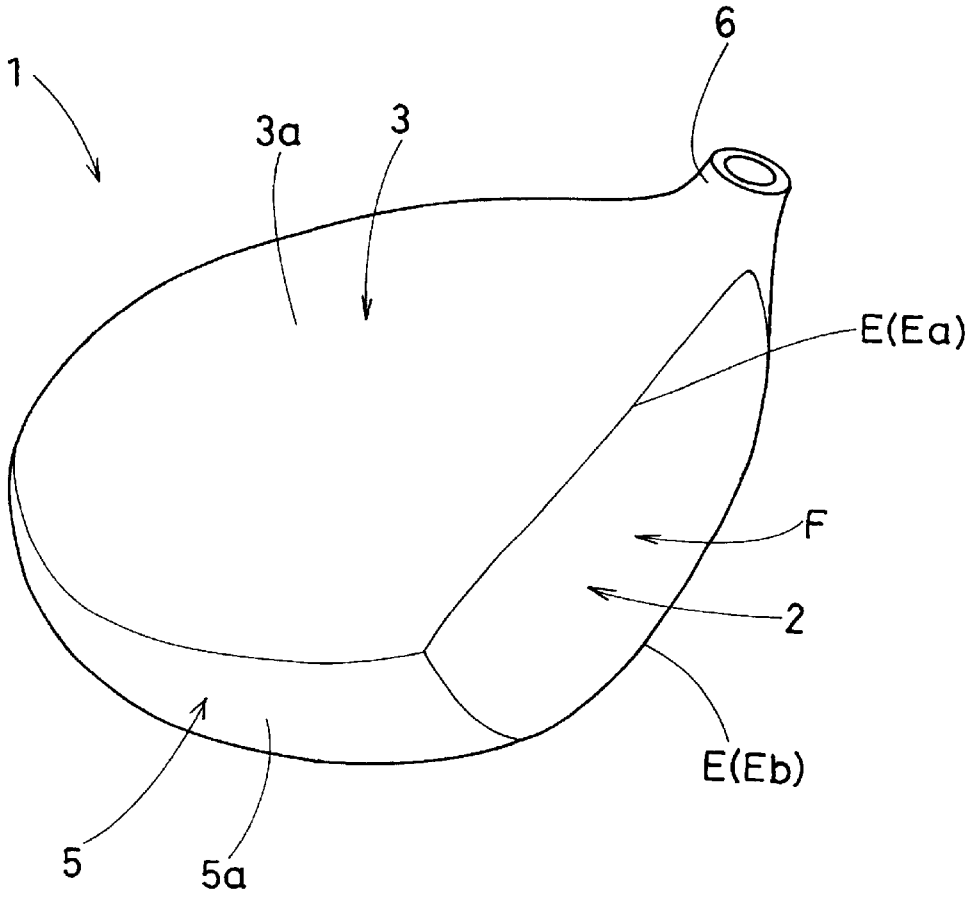
FIG. 1 is a perspective view of a golf club head according to the present invention.

Embodiments of the present invention will now be described in detail in conjunction with the accompanying drawings.

In the drawings, a golf club head 1 according to the present invention comprises a face portion 2 the surface of which defines the face F for striking a golf ball, a crown portion 3 defining the top face 3*a* of the golf club head, a sole portion 4 defining the sole or bottom face of the golf club head, a side portion 5 extending between the crown portion 3 and sole portion 4 and defining the side face 5*a* of the golf club head, and a hosel 6 attached to the end of a golf club shaft.

Definition

Figure 5:
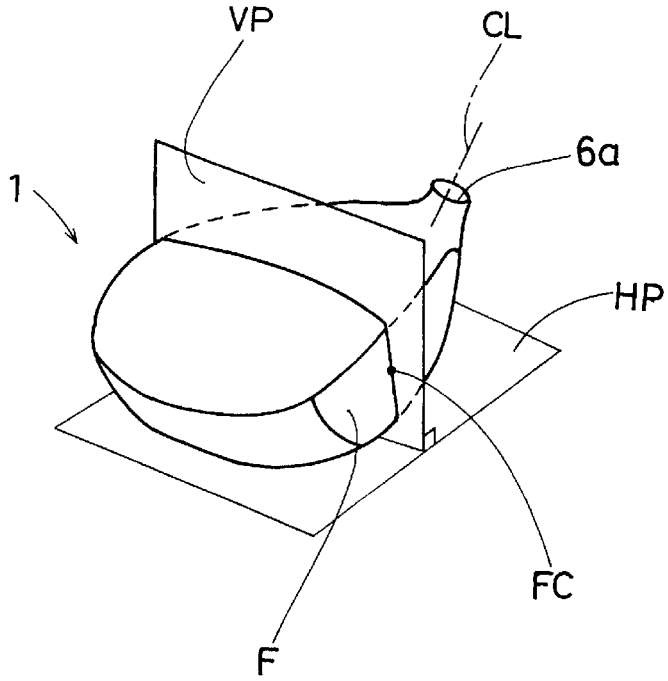
FIG. 5 is a diagram for explaining a measuring state of a golf club head.

Measuring state: A state of the golf club head 1 which is, as shown in FIG. 5, set on a horizontal plane HP such that the face F forms its loft angle with respect to the horizontal plane HP, and the center line CL of the golf club shaft is inclined at the lie angle beta while keeping the center line CL on a vertical plane (not shown).

Sweet spot SS: The point of intersection between the face F and a straight line K drawn normally to the face F passing the center of gravity G of the golf club head. (see FIG. 6(B))

Figure 6A:
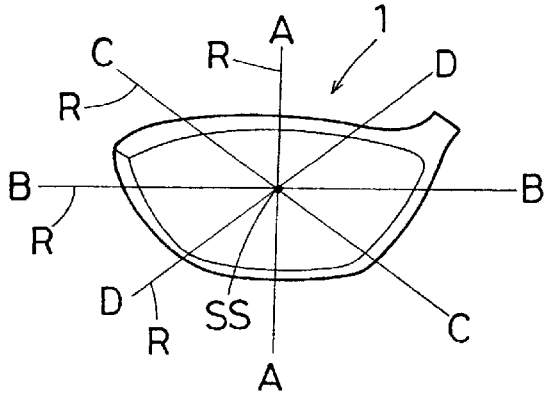
FIGS. 6(A), 6(B) and 6(C) are diagrams for explaining the definition of the edge of a ball striking face.
Figure 6B:
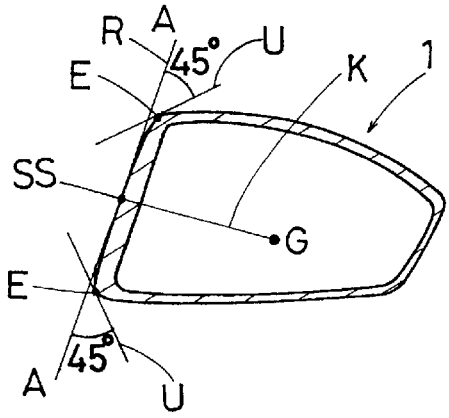
Figure 6C:
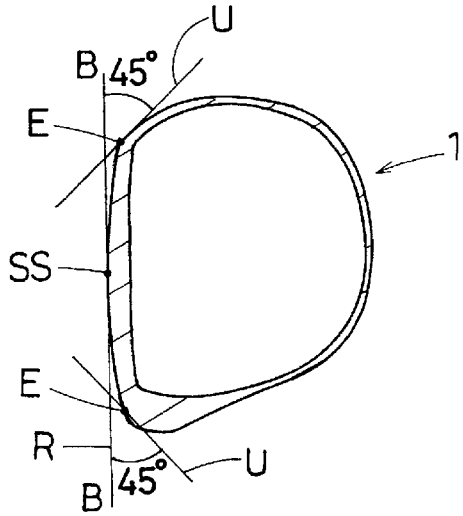

Face edge E: The edge of the face F which is defined as follows. As shown in FIGS. 6(A), 6(B) and 6(C), a tangent R to the face F at the sweet spot SS is defined—(In FIG. 6(A), only four lines A, B, C and D are drawn, indeed, the tangent R is innumerable lines) and a straight line u is drawn backward from the tangent R wile inclining outside at an angle of 45 degrees with respect to the tangent R so that the straight line U comes into contact with the surface of the golf club head at a point, and using this contact point, the edge E is defined as the continuity of such contact point.

Face height (h): The height of the face F as measured in the vertical direction between the uppermost point and the lowermost point on the face edge E under the measuring state. (see FIG. 7)

Face width (w): The width of the face F as measured in the horizontal direction between the extreme end points on the face edge E in the horizontal direction under the measuring state. (see FIG. 7)

Figure 7:
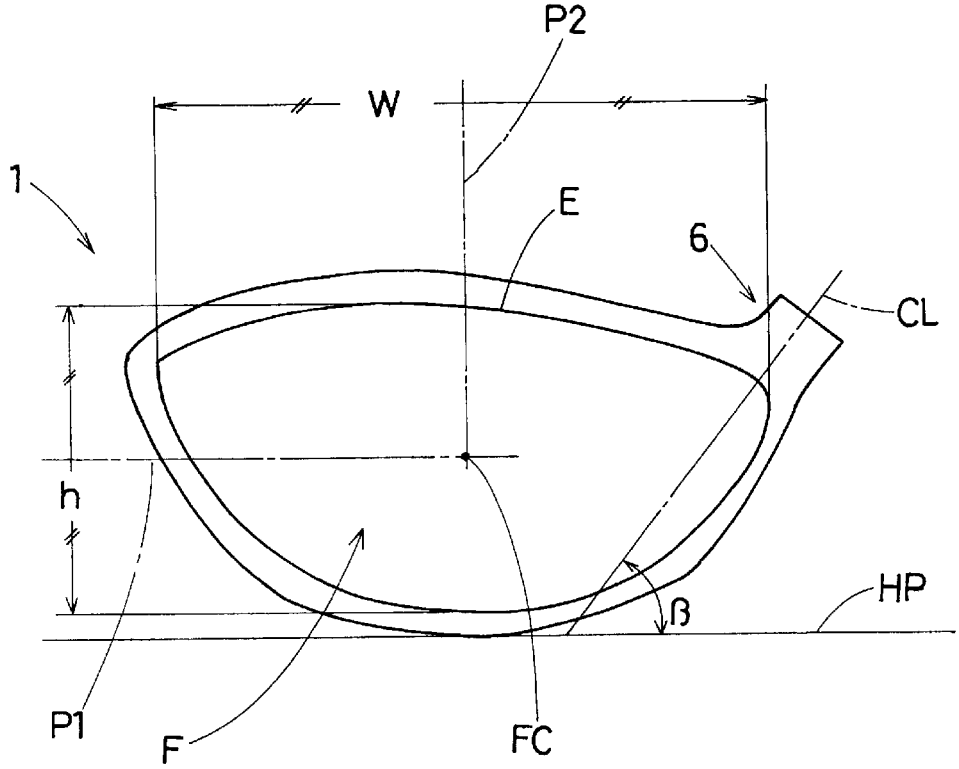
FIG. 7 is a front view of a golf club head for explaining the face center.

Face center Fc: The center point of the face F which is, as shown in FIG. 7, defined as a point of intersection of the face F, a horizontal plane HP2 at the middle of the face height (h), and a vertical plane VP2 at the middle of the face width (w).

FIG. 1 shows a wood-type hollow-center metal head 1 as an embodiment of the present invention.

Figure 2:
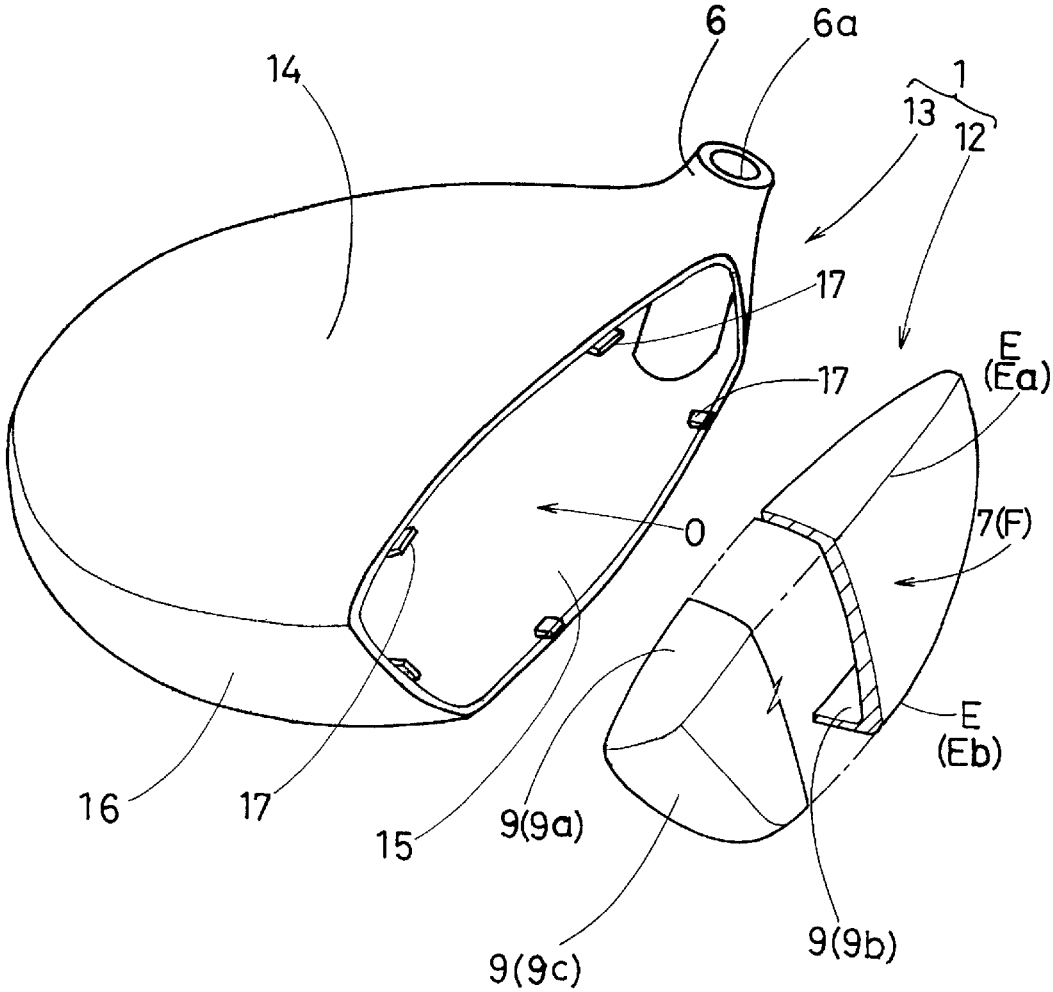
FIG. 2 is an exploded perspective view thereof.
Figure 3:
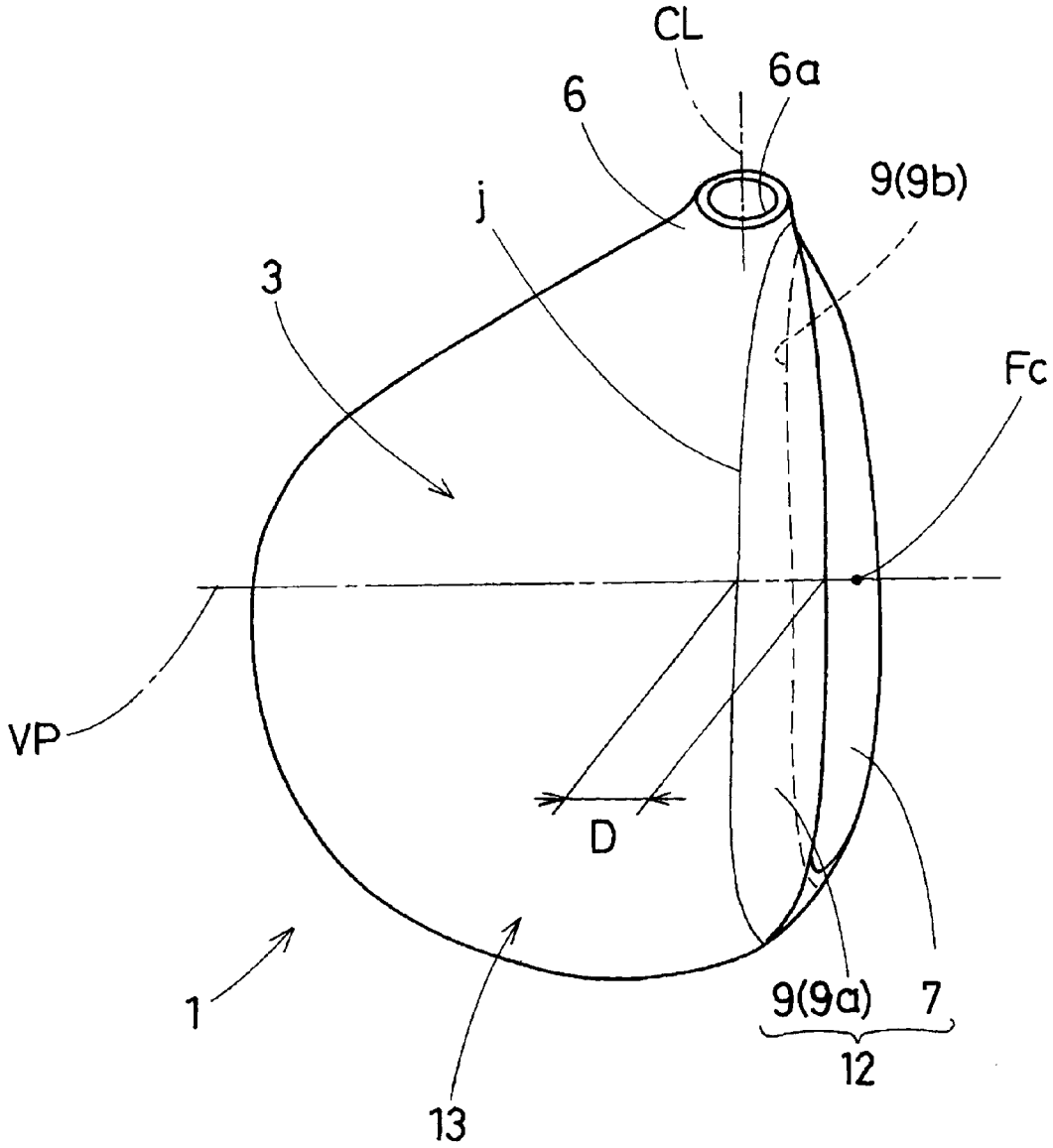
FIG. 3 is a top view of the golf club head.

The golf club head 1 is, as shown in FIG. 2, composed of a main body 13 and a face member 12.

The face member 12 is fixed to the front of the main body 13 to form at least the face portion 2. In this example, the face member 12 and main body 13 are welded.

The head main body 13 is composed of the above-mentioned hosel 6, a part 14 forming a major part of the crown portion 3 (hereinafter, the "crown major part 14"), a part 15 forming a major part of the sole portion 4 (hereinafter, the "sole major part 15"), and a side major part 16 extending from the crown major part 14 to the sole major part 15. Thus, an opening O is formed at the front of the head main body 13 which is closed by the attached face member 12. For the purpose of positioning and temporarily fixing of the face member 12, the head main body 13 is provided inside the opening O with hooks 17 along the edge of the opening O.

The hosel 6 is provided with a shaft inserting hole 6*a*, of which center line CL can be used instead of the center line of the golf club shaft when setting up the golf club head 1 alone at the lie angle.

For making the head main body 13, various metallic materials such as aluminum alloy, pure titanium, titanium alloy, stainless steel and the like can be used.

In this example, the head main body 13 is formed as a precision casting of an alpha-beta-type titanium alloy Ti-6Al-4V using a lost-wax process. It is however also possible to employ another method in order to make the head main body 3. Also it is possible to use another material.

The head main body 13 in this example is single-piece. However, the head main body 3 may be composed of two or more separate parts united with each other by means of welding or the like.

On the contrary, the face member 12 has to be single-piece. The face member 12 is made up of a main portion 7 and an extended part 9.

The main portion 7 forms the face portion 2. Thus the surface of the main portion 7 defines the face F. The main portion 7 in this example is platy.

The extended part 9 extends backward from the face edge E. The extended part 9 in this example includes a part 9*a* forming the remaining minor part of the crown portion 3, a part 9*b* forming the remaining minor part of the sole portion 4, and a part 9*c* forming the remaining minor part of the side portion 5. The extended part 9 supports the main portion 7 at a certain distance from the front of the head main body 13 while forming a hollow behind the entirety of the face portion 2.

As explained, the main portion 7 and extended part 9 are not separate parts united by means of welding and the like. They are formed integrally by means of bending, press working, casting, forging and the like.

For the face member 12, a beta-type titanium alloy is used in this example, although various metallic materials can be used. A beta-type titanium alloy includes an element such as vanadium (V), molybdenum (Mo) or the like which can make beta-solid solution in a metastable state at a room air temperature together with titanium. In this example, Ti-15V-3Cr-3Al-3Sn is used. But, it is also possible to use other beta-type titanium alloys such as Ti-22V-4Al, Ti-15Mo-5Zr-3Al, Ti-10V-2Fe-3Al, Ti-13V—11Cr-3Al, Ti-8Mo-8V-2Fe-3Al, Ti-3Al-8V-6Cu-4Mo-4Zr, Ti-11.5Mo-6Zr-4.5Sn, Ti-15Mo-5Zr and the like.

The face member 12 may be formed by forging, press working, casting, and the like according to the material used, as far as the main portion 7 and extended part 9 are integrally formed. In this example, forging is employed because the used material is a beta-type titanium alloy for which it is difficult to employ casting. If press working is employed, a plate having a specific thickness distribution is made first and then bent into a specific shape like a cup.

The present inventor discovered that it is better to decrease the rigidity in a portion surrounding the face F in order to cause a vibration of the face portion which is effective in rebounding the ball. On the other hand, there is a tendency for a weld bead to increase the thickness and thereby to increase the rigidity. Thus, it is not desirable that welded part approaches the face edge E.

The extended part 9 is therefore, formed so as to have a length D in a range of not lass than 5 mm, preferably not less than 10 mm, more preferably not less than 15 mm. By setting the length D as above, the impact due to ball striking is dispersed and/or damped while being transmitted to the junction (j), and its magnitude at the junction (j) is reduced. Therefore, damage occurring from the junction (j) can be prevented.

On the other hand, if the length D is too long, plastic forming is difficult and thus it becomes difficult to make the face member 12 by forging, press working and the like or the production efficiency greatly decreases.

Therefore, the length D of the extended part 9 is set in a range of not more than 30 mm, preferably not more than 28 mm, more preferably not more than 25 mm.

Here, the length D of the extended part 9 is defined as measured horizontally in the back and forth direction from the face edge E under the measuring state.

Although the crown-side extended part 9*a* and the sole-side extended part 9*b* in this embodiment are of the almost same length D, it is also possible to provide different lengths between the parts 9*a* and 9*b*. When the head is viewed in the vertical direction as shown in FIG. 6, in each of the crown-side extended part 9*a* and sole-side extended part 9*b*, due to the curvature, the length D gradually decreases near the toe-side end and heel-side end, towards the toe-side end and heel-side end, and the length D becomes maximum near the vertical plane VP2.

As to the thickness distribution of the face member 12, the average thickness of the extended part 9 is set to be less than the average thickness of the main portion 7, whereby the restitution coefficient can be improved without decreasing the durability of the main portion 7.

Figure 4:
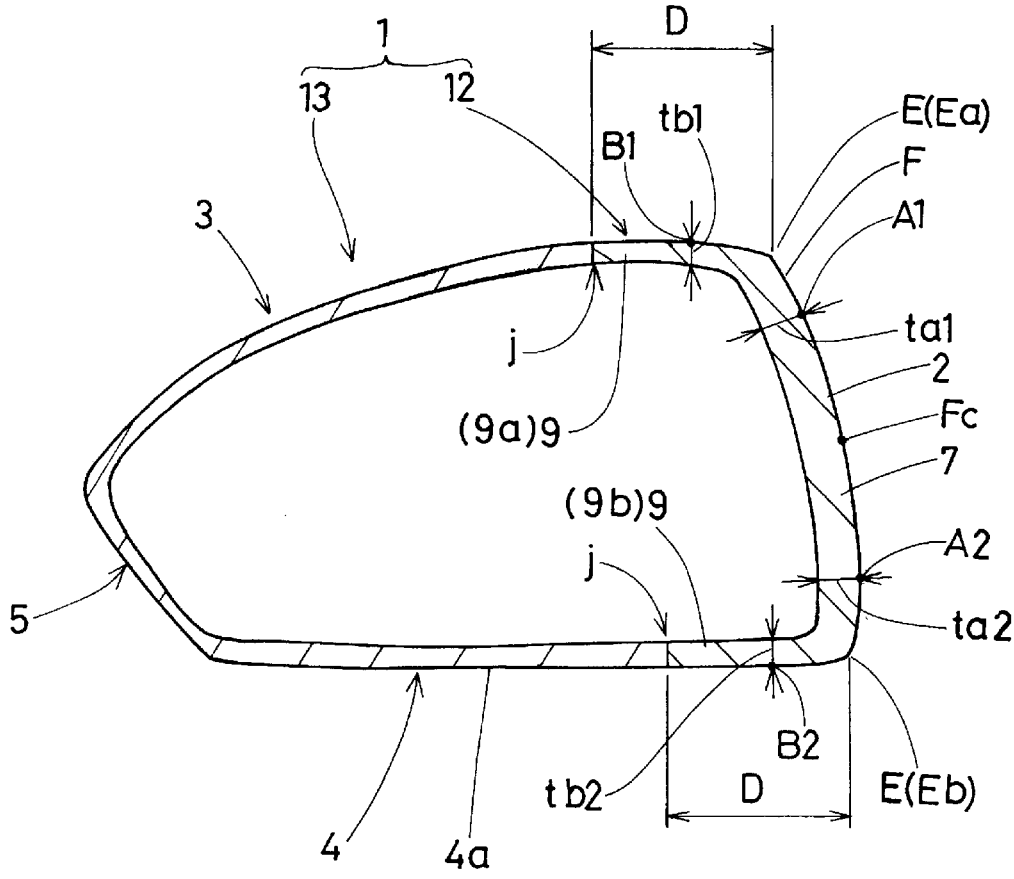
FIG. 4 is a cross sectional view of the golf club head.

In case of the crown-side extended part 9*a*, the thickness distribution preferably satisfies the following condition. Given that, as shown in FIG. 4, "ta1" is the thickness measured at a point A1 on the face F at a distance of 5 mm along the face F from the upper-side face edge Ea (E) of the face F, and "tb1" is the thickness measured at a point B1 on the crown-side extended part 9*a* at a distance of 5 mm from the upper-side face edge Ea (E) along the crown-side extended part 9*a*, the difference Δt1 (=ta1−tb1) of the thickness ta1 from the thickness tb1 is in a range of from 1.0 to 2.5 mm, more preferably 1.2 to 2.0 mm, still more preferably 1.3 to 1.5 mm.

In case of the sole-side extended part 9*b*, the thickness distribution preferably satisfies the following condition. Given that, as shown in FIG. 4, "ta2" is the thickness measured at a point A2 on the face F at a distance of 5 mm along the face F from the lower-side face edge Eb (E) of the face F, and "tb2" is the thickness measured at a point B2 on the sole-side extended part 9*b* at a distance of 5 mm along the sole-side extended part 9*b* from the lower-side face edge Eb, the difference Δt2 (=ta2−tb2) of the thickness "ta2" from the thickness "tb2" is in a range of from 1.0 to 2.5 mm, more preferably 1.0 to 2.0 mm, still more preferably 1.3 to 1.5 mm.

In case of the part 9*c* forming the minor part of the side portion 5, same applies to.

Specifically, the thickness "ta" (ta1, ta2) of the main portion 7 is set in a range of from 1.8 to 3.5 mm, preferably 2.0 to 3.0 mm. If the thickness "ta" is less than 1.8 mm, there is a possibility that the main portion 7 suffers damage such as crack or plastic deformation such as dent from the impact at the time of striking a ball. If the thickness "ta" is more than 3.5 mm, there is a tendency for the restitution coefficient to decrease and the weight of the golf club head increases.

On the other hand, the thickness "tb" (tb1, tb2) of the extended part 9 is specifically set in a range of from 0.5 to 1.7 mm, more preferably 0.5 to 1.2 mm, still more preferably 0.7 to 1.0 mm, while satisfying the above thickness distribution. If the thickness "tb" is less than 0.5 mm, the strength is greatly decreased, and the welding becomes difficult.

In this embodiment, as shown in FIG. 4, the rear end of the extended part is butt welded to the above-mentioned major part (15, 16) of the head main body 13. At or near the junction (j) therebetween, the thickness of the extended part 9 is the substantially same as that of the major part.

Further, the thickness of the extended part 9 is substantially constant from the point B(B1, B2)—in this embodiment from a point near the face edge E—to the rear end (j) of the extended part 9. The thickness of the main portion 7 is substantially constant between the point A1 and point A2—in this embodiment between points near the face edges Ea and Eb.

Because of such thickness distribution and also thank to the length D of the extended part 9, the rigidity can be more effectively decreased while maintaining the strength in the surrounding area of the face portion 2, and as a result, the restitution coefficient can be further improved.

As another example of the extended part 9, it may be possible to form the face member 12 having the crown-side extended part 9*a* and sole-side extended part 9*b* only, or the part 9*a* only, or the part 9*b* only or the like.

Comparison Tests

Wood-type golf club heads shown in FIG. 1 were made and tested for the durability and restitution coefficient.

The following were common to all the golf club heads.

Weight of Head: 185 g

Thickness of crown portion: 1.0 mm

Thickness of sole portion: 1.3 mm

Thickness of side portion: 1.0 mm

Loft angle: 10 degrees

Lie angle: 56 degrees

Hook angle: 2.5 degrees

Other specifications and test results are shown in Table 1.

Durability Test 1

The golf club head was fixed and golf balls ("Maxfli Hi-Brid" TM, manufactured by Sumitomo Rubber Industry, Ltd.) were hit 300 times against the face F perpendicularly thereto at a speed of 55 m/s, and then the face was visually checked for damage.

Durability Test 2

The golf club head was attached to an FRP shaft to make a 45-inch wood-type golf club. The club was attached to a swing robot and hit the above-mentioned golf balls 3000 times at a head speed of 50 m/s. Then, the ball striking face was checked and if a dent was found the depth was measured.

Restitution Coefficient Test

According to the "Procedure for Measuring the Velocity Ratio of a Club Head for Conformance to Rule 4-1e, Appendix II, Revision 2 (Feb. 8, 1999), United States Golf Association.", the restitution coefficient "e" was obtained. As specified therein, the golf balls used were "Titleist, PINNACLE GOLD." and the radius of the target circle centered on the sweet spot was 5 mm. However, the distance between the face and the launching device was changed to one meter, and the incoming ball velocity was 48.77 meter/second. The ball velocity sensors was set at 360.2 mm and 635 mm from the golf club head.

$$Vo/Vi=(eM-m)/(M+m)$$

where

Vo: ball rebound velocity

Vi: ball incoming velocity

M: the mass of the club head m: the mass of the ball.

As apparent from the test results, it was confirmed that golf club heads according to the invention can be improved in the durability and restitution coefficient.

The present invention can be applied to not only the wood-type golf club heads but also iron-type, utility-type and putter-type golf club heads as far as the golf club head has a hollow behind the face portion.

TABLE 1

| Head | Ex. 1 | Ex. 2 | Ex. 3 | Ex. 4 | Ex. 5 | Ex. 6 | Ex. 7 |
|---|---|---|---|---|---|---|---|
| Club head structure *1 | FIG. 2 | FIG. 2 | FIG. 2 | FIG. 2 | FIG. 2 | FIG. 2 | FIG. 2 |
| Face member | | | | | | | |
| Material *2 | Ti-15V-3Cr-3Al-3Sn | ← | ← | ← | ← | ← | ← |
| Making method | forging | forging | forging | forging | forging | forging | forging |
| ta (mm) | 2.3 | 1.8 | 3.5 | 2.2 | 3 | 2.3 | 2.3 |
| tb (mm) | 0.9 | 0.8 | 1 | 1.2 | 0.5 | 0.9 | 0.9 |
| ta-tb (mm) | 1.4 | 1 | 2.5 | 1 | 2.5 | 1.4 | 1.4 |
| Extended part Length D *3 (mm) | 15 | 15 | 15 | 15 | 15 | 5 | 30 |
| Durability 1 *4 | no damage | no damage | no damage | no damage | no damage | no damage | no damage |
| Durability 2 *4 Dent (mm) | 0.04 | 0.08 | 0.01 | 0.05 | 0.02 | 0.03 | 0.05 |
| Restitution coefficient e | 0.86 | 0.887 | 0.828 | 0.857 | 0.856 | 0.857 | 0.862 |

Figure 8:
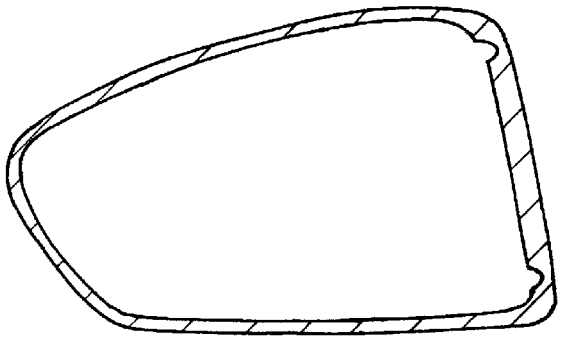
FIG. 8 is a cross sectional view of a golf club head used in comparison tests.
Figure 9A:
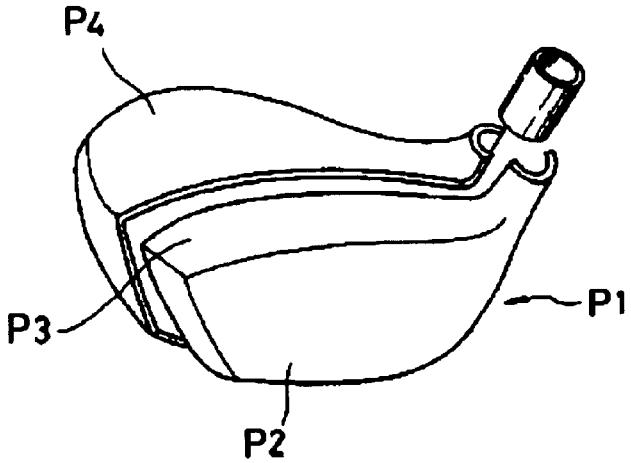
FIG. 9(A) is an exploded perspective view of the golf club head according to the prior art.
Figure 9B:
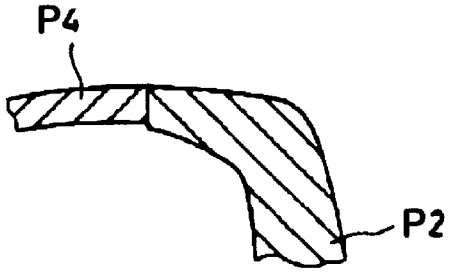
FIG. 9(B) is a cross sectional partial view thereof.

| Head | Ref. 1 | Ref. 2 | Ref. 3 | Ref. 4 | Ref. 5 | Ref. 6 | Ref. 7 |
|---|---|---|---|---|---|---|---|
| Club head structure *1 | FIG. 2 | FIG. 2 | FIG. 2 | FIG. 2 | FIG. 2 | FIG. 2 | FIG. 8 |
| Face member | | | | | | | |
| Material *2 | ← | ← | ← | ← | ← | ← | Ti-6Al-4V |

TABLE 1-continued

| Making method | forging | forging | forging | forging | forging | forging | casting |
|---|---|---|---|---|---|---|---|
| ta (mm) | 1.7 | 3.6 | 1.9 | 2.8 | 2.3 | 2.3 | 2.3 |
| tb (mm) | 0.9 | 0.9 | 0.4 | 1.3 | 0.9 | 0.9 | 0.9 |
| ta-tb (mm) | 0.8 | 1.7 | 1.5 | 1.5 | 1.4 | 1.4 | 1.4 |
| Extended part Length D *3 (mm) | 15 | 15 | 15 | 15 | 0 | 35 | — |
| Durability 1 *4 | 120 times | no damage | 250 times | no damage | no damage | 290 times | no damage |
| Durability 2 *4 Dent (mm) | 800 times | 0.01 | 1250 times | 0.04 | 0.02 | 0.11 | 0.05 |
| Restitution coefficient e | 0.891 | 0.787 | 0.889 | 0.81 | 0.791 | 0.861 | 0.795 |

*1) Head main body was a precision casting of Ti-6Al-4V by lost-wax process
*2) ←: Same as in the left
*3) The extended parts 9a, 9b and 9c were the same length D.
*4) Number of times means that the face portion was broken at that times.

What is claimed is:

1. A golf club head comprising:

a main body and a face member attached to the main body, the face member comprising a main portion and an extended part, the main portion forming a ball striking face, the extended part extending 5 to 30 mm backward from at least part of the edge of the ball striking face, and the extended part having a thickness less than a thickness of the main portion;

wherein the extended part includes a crown-side extended part forming a part of a crown portion of the head, and a sole-side extended part forming a part of a sole portion of the head;

wherein given that, in at least a cross section of the golf club head along a vertical place including a normal line drawn to the ball striking face at the center point thereof, "ta1" is a thickness measured at a point on the ball striking face at a distance of 5 mm along the ball striking face from the upper edge of the ball striking face, and "tb1" is a thickness measured at a point on the crown-side extended part at a distance of 5 mm from the upper edge along the crown-side extended part, the difference (ta1–tb1) of the thickness ta1 from the thickness tb1 is in a range of from 1.0 to 2.5 mm; and wherein given that, in at least a cross section of the golf club head along a vertical plane including a normal line drawn to the ball striking face at the center point, "ta2" is a thickness measured at a point on the ball striking face at a distance of 5 mm along the ball striking face from the lower edge of the ball striking face, and "tb2" is a thickness measured at a point on the sole-side extended part at a distance of 5 mm along the sole-side extended part from the lower edge, the difference (ta2–tb2) of the thickness "ta2" from the thickness "tb2" is in a range of from 1.0 to 2.5 mm.

2. A golf club head comprising:

a main body and a face member attached to the main body, the face member comprising a main portion and an extended part, the main portion forming a ball striking face, the extended part extending 5 to 30 mm backward from at least part of the edge of the ball striking face, and a thickness of the extended part being less than a thickness of the main portion;

wherein the extended part include a crown-side extended part forming a part of a crown portion of the head, and a sole-side extended part forming a part of a sole portion of the head; and wherein given that, in at least a cross section of the golf club head along a vertical place including a normal line drawn to the ball striking face at the center point thereof, "ta1" is a thickness measured at a point on the ball striking face at a distance of 5 mm along the ball striking face from the upper edge of the ball striking face, and "tb1" is a thickness measured at a point on the crown-side extended part at a distance of 5 mm from the upper edge along the crown-side extended part, the difference (ta1–tb1) of the thickness ta1 from the thickness tb1 is in a range of from 1.0 to 2.5 mm.

3. A golf club head wherein a main body and a face member attached to the main body, the face member comprising a main portion and an extended part, the main portion forming a ball striking face, the extended part extending 5 to 30 mm backward from at least part of the edge of the ball striking face, and a thickness of the extended part being less than a thickness of the main portion;

wherein the extended part includes a crown-side extended part forming a part of a crown portion of the head, and a sole-side extended part forming a part of a sole portion of the head; and wherein given that, in at least a cross section of the golf club head along a vertical plane including a normal line drawn to the ball striking face at the center point, "ta2" is a thickness measured at a point on the ball striking face at a distance of 5 mm along the ball striking face from the lower edge of the ball striking face, and "tb2" is a thickness measured at a point on the sole-side extended part at a distance of 5 mm along the sole-side extended part from the lower edge, the difference (ta2–tb2) of the thickness "ta2" from the thickness "tb2" is in a range of from 1.0 to 2.5 mm.

4. A golf club head according to any one of claims 1, 2 and 3, wherein the face member is single-piece.

5. A golf club head according to any one of claims 1, 2 or 3, wherein the face member is a single-piece and made of a beta-type titanium alloy.

6. A golf club head according to any of claims 1, 2 or 3, wherein the main body is a single-piece casting of an alpha-beta-type titanium alloy.

7. A golf club head according to any of claims 1, 2 or 3, wherein the main body is a single-piece casting of an alpha-beta-type titanium alloy, and the face member is single-piece and made of a beta-type titanium alloy.

8. A golf club head according to any one of claims 1, 2 or 3, wherein the difference (ta1−tb1) is in a range of from 1.2 to 2.0 mm, and wherein the difference (ta2−tb2) is in a range of from 1.0 to 2.0 mm.

9. A golf club head according to any one of claims 1, 2 or 3, wherein the difference (ta1−tb1) is in a range of from 1.3 to 1.5 mm, and wherein the difference (ta2−tb2) is in a range of from 1.3 to 1.5 mm.

* * * * *